US005575451A

United States Patent [19]

Colvin et al.

[11] Patent Number: 5,575,451

[45] Date of Patent: Nov. 19, 1996

[54] BLOWOUT PREVENTER RAM FOR COIL TUBING

[75] Inventors: Kenneth W. Colvin; William L. Carbaugh, both of Humble, Tex.

[73] Assignee: Hydril Company, Houston, Tex.

[21] Appl. No.: 434,042

[22] Filed: May 2, 1995

[51] Int. Cl.[6] ..... E21B 33/06

[52] U.S. Cl. ..... 251/1.3; 251/1.1

[58] Field of Search ..... 251/1.1, 1.3

[56] References Cited

U.S. PATENT DOCUMENTS

| | | | |
|---|---|---|---|
| 1,586,923 | 6/1926 | Townsend | 251/1.3 X |
| 4,508,313 | 4/1985 | Jones | 251/1.3 |
| 5,013,005 | 5/1991 | Nance | 251/1.3 |
| 5,089,289 | 2/1992 | Nance | 251/1.3 X |

*Primary Examiner*—John Fox
*Attorney, Agent, or Firm*—Vaden, Eickenroht & Thompson, L.L.P.

[57] ABSTRACT

A ram for a blowout preventer for coil tubing is disclosed. It includes a ram body having a flat face with a semi-circular cavity therein for engaging the flat face of an oppositely facing ram having a semi-circular cavity in its face. A seal member is carried by the ram to engage a seal member carried by the opposite facing ram to prevent the flow of fluid between the rams and a section of coil tubing extending vertically between the rams and encircled by the semi-circular cavities in the faces of the rams. An integral elastomeric pipe guide is carried by the ram to urge the tubing to the center of the preventer. A plurality of slip segments are mounted on the ram in the semi-circular cavity on opposite sides of the seal member to engage the tubing and hold the tubing from moving downwardly or upwardly relative to the ram.

3 Claims, 4 Drawing Sheets

70
66
58b
56
60
64
34
38
41
42
46
58d
46
72
70
74
30
16
52
50
54
28
52
58c
32
66
58a
44
36
39
40
46
72

14
12
70
34
W
50
47b
47b
30
47
47a
47a
47
T
45a
45a
45
45
28
45b
45b
50
32
72

BLOWOUT PREVENTER RAM FOR COIL TUBING

This invention relates to rams for blowout preventers generally, and in particular, to blowout preventer rams for use with coiled tubing.

Coiled tubing is essentially a continuous string of pipe that is coiled on a reel at the surface and inserted into an oil or gas well mostly for workover purposes although the coiled tubing can be used for drilling. For example, horizontal drain holes are often drilled using coiled tubing. The advantages of coiled tubing, of course, is that there are no connections to be made up as the pipe string is run in and pulled out of a well.

There are occasions, however, when tools must be inserted in the coiled tubing. This requires the coiled tubing to be cut to receive the tool, after which the two severed ends are reconnected using couplings. It is important that the connection between the couplings and the tubing be tested before running the couplings into the hole. This is done at the present time by using a blowout preventer ram containing slips that grip the tubing and allow an upward pull to be placed on the tubing to test the connection between the couplings and the tubing. The slips on these rams are a series of internal grooves in the walls of the semi-circular cavities in each ram that engage the pipe when the rams are closed around the pipe. This creates a rigid "clam shell" arrangement that engages the tubing in a narrow area at two places around the circumference. This arrangement can result in damage to the tubing. Another drawback of the two ram arrangement is that the height of the blowout preventer stack is increased because a second set of rams must be provided to seal around the pipe in case of a blowout.

Therefore, it is an object and feature of this invention to provide a blowout preventer ram that can form a seal and prevent fluid from flowing past the ram when it is in engagement with the tubing and also hold the tubing from moving upwardly or downwardly relative to the ram.

It is a further object and feature of this invention to provide such a ram that engages the tubing with slips that extend over a wide area of the tubing to reduce the possibility of damaging the tubing due to the crushing forces of the slips.

It is a further object of this invention to provide a blowout preventer ram that can provide both a sealing function and a holding function so that only one blowout preventer is required.

It is a further object and feature of this invention to provide pipe guides to center the coil tubing in the preventer as the rams close that are an integral part of the elastomeric seal assembly carried by the rams.

These and other objects, advantages, and features of this invention will be apparent to those skilled in the art from a consideration of this specification including the attached drawings and appended claims.

Figure 1:
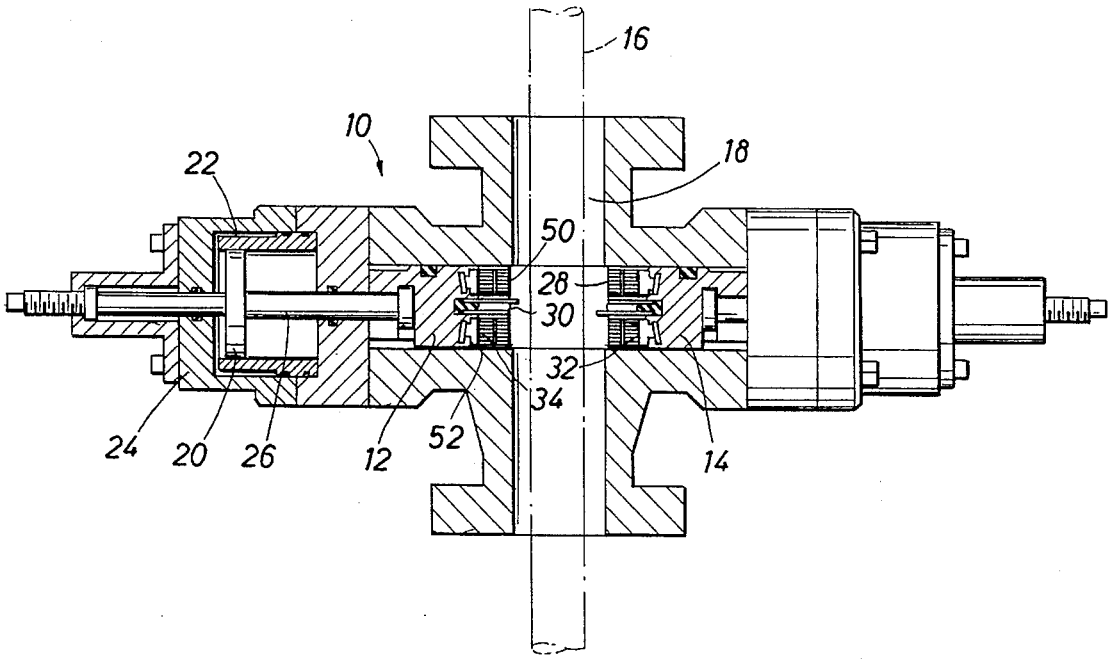
FIG. 1 is a view partly in elevation and partly in section of a ram-type blowout preventer equipped with the rams of this invention.
Figure 4:
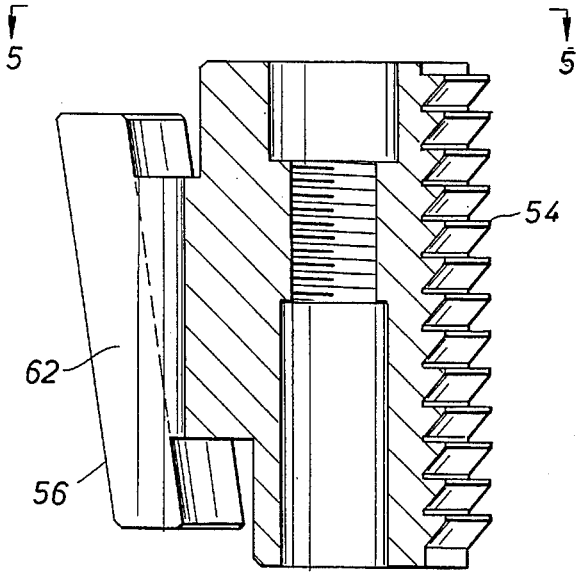
FIG. 4 is a sectional view of a slip segment of this invention taken along line 4—4 of FIG. 5.

In FIG. 1, blowout preventer 10 is a hydraulically operated ram-type preventer of conventional design. It includes rams 12 and 14 that are moved into and out of engagement with pipe string 16, indicated in dashed lines, extending through bore 18 of the preventer. The entire lefthand side of the preventer is in section to show the structural arrangement for moving ram 12 into and out of engagement with the pipe string. Specifically, ram 12 is moved in opposite directions by hydraulic fluid acting on one side or the other of piston 20 located in cylinder 22. Piston rod 26 connects the ram to the piston for movement therewith. Ram 14 is moved into and out of engagement with the pipe string 16 in a similar manner.

Rams 12 and 14 have opposing flat faces 28 and 30 in which semi-circular cavities 32 and 34 are located. Semi-circular horizontal slots 36 and 38 are positioned in the cavities to support semi-circular seal assemblies 39 and 41. These assemblies include semi-circular seal members 40 and 42 of elastomeric material that extend outwardly from the cavities between retaining plates 44 and 46. The elastomeric seal members extend beyond these plates to engage coiled tubing 16 and seal the space between the tubing and the rams to prevent fluid from flowing upwardly past the rams.

Figure 6:
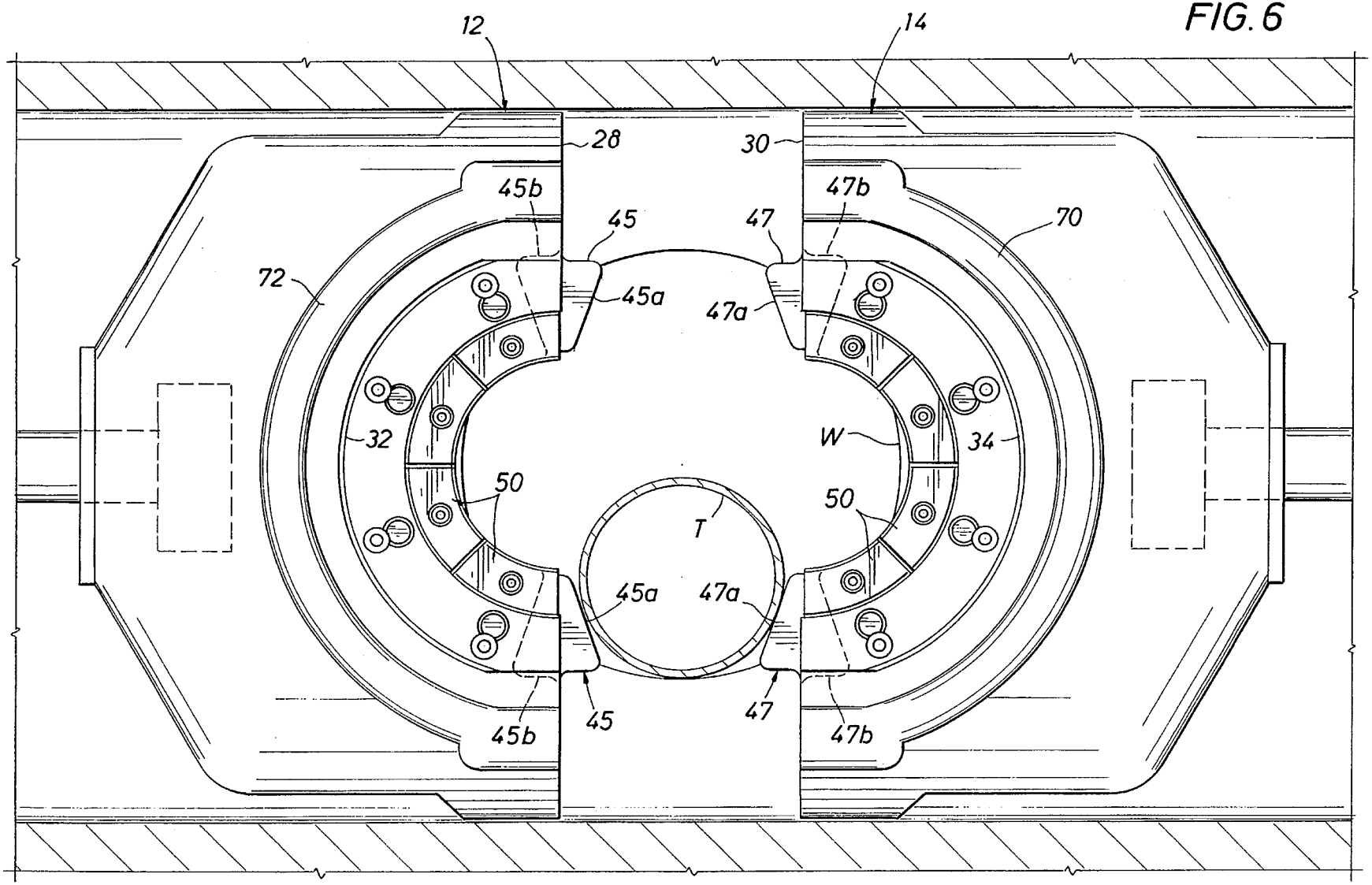
FIG. 6 is a top view of the rams of this invention in the open position.

As best seen in FIG. 6, where the rams are shown in the open position, seal retaining plates 44 and 46 include integral pipe guides 45 and 47 for urging the coiled tubing to move toward the center of the preventer as the rams move toward engagment with the tubing. For this purpose, each guide has pipe engaging surfaces 45*a* and 47*a* that are inclined such that each guide will exert a force on the tubing having a component urging the tubing toward the center of the opening through the preventer. An extreme example is shown in FIG. 6, where coiled tubing T is in engagement with wall W of the bore through the preventer and would make it difficult to close the rams without the pipe guides to urge the tubing laterally toward the center of the preventer as the rams move together. Cavities 45*b* and 47*b* in the seal retaining plates receive pipe guides 47 and 45, respectively, when the rams are closed.

Figure 5:
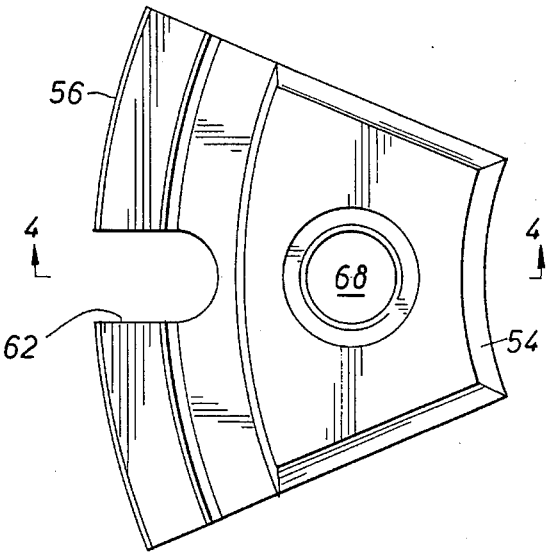
FIG. 5 is a top view of the slip segment of FIG. 4 looking in the direction of the arrows 5—5.
Figure 2:
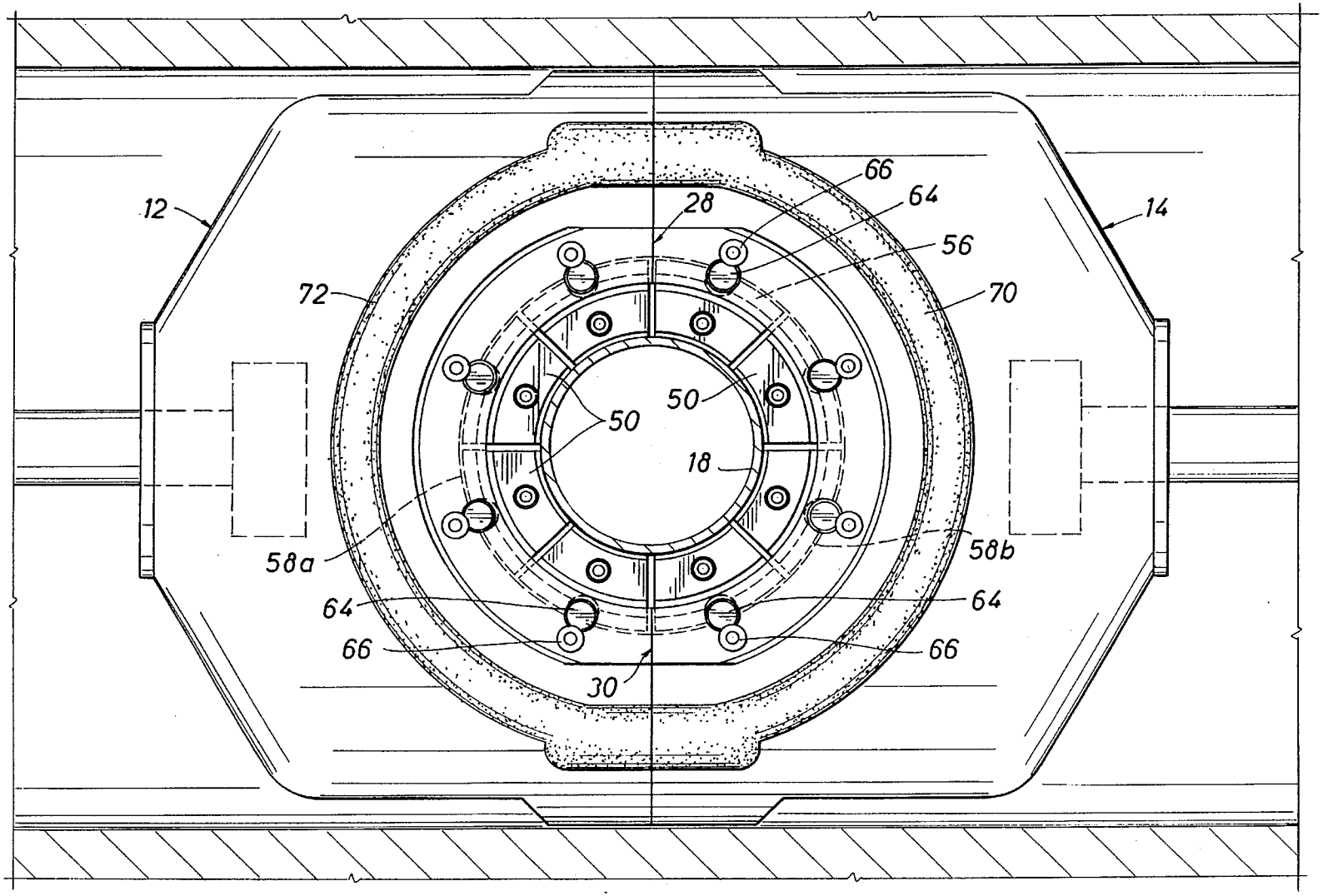
FIG. 2 is a top view of the rams of this invention in a closed position around a string of coiled tubing.
Figure 3:
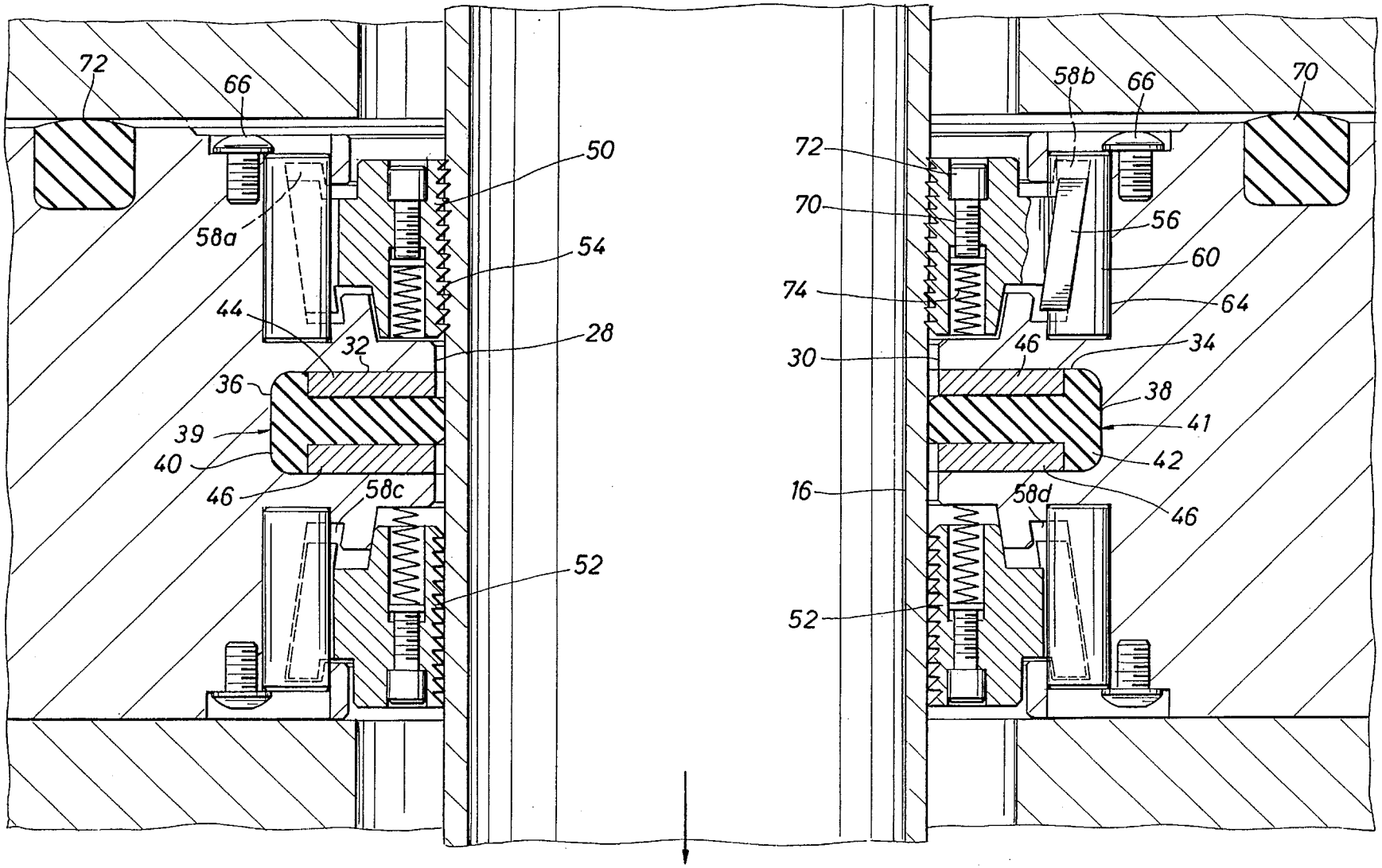
FIG. 3 is a vertical sectional view on an enlarged scale of the rams closed around a string of coiled tubing with the upper slips in engagement with the tubing to resist downward movement of the tubing relative to the blowout preventer.

Each ram is provided with an upper slip assembly and a lower slip assembly on opposite sides of the seal assembly. The slip segments making up each slip assembly are identical. A top view of a typical segment is shown in FIG. 5. It is generally pie-shaped and of a size that each ram carries four upper slip segments 50 and four lower slip segments 52. Each segment is provided with teeth 54 for engaging the coiled tubing. Inclined guide members 56 on the back side of the slip segments are positioned in semi-circular grooves 58*a*–58*d* in the body of the rams that are inclined to match the angle from the vertical of guide members 56 to hold the slips in a vertical plane. Retaining pins 60 are positioned in slots 62 that are machined in the side of the slip segments opposite the slips to hold the slips from lateral movement in grooves 58*a*–58*d*. As shown in FIGS. 2 and 3, the pins are held in place by cap screws 66. Each slip segment also has vertical opening 68 that includes tapped section 70 to receive screw 72. Coil springs 74 move the upper slips upwardly and the lower slips downwardly when the slips are out of engagement with the pipe string. There will, of course, be sufficient contact with the pipe string when the rams are closed that any movement up or down by the pipe string will set the appropriate set of slips and stop the movement.

The rams are also provided with upper seal members 70 and 72 that combine as shown in FIG. 2 to provide a seal between the top of the rams and the blowout preventer wall and combines with seals 40 and 42 to prevent fluid from flowing upwardly past the rams.

From the foregoing it will be seen that this invention is one well adapted to attain all of the ends and objects hereinabove set forth, together with other advantages which are obvious and which are inherent to the apparatus and structure. Specifically, one set of rams is provided that will seal the annulus between the pipe string and the rams when the rams are closed around the pipe string and that will hold the pipe string from upward and downward movement.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A blowout preventer ram for combining with another ram to engage a coil tubing string extending through the blowout preventer to prevent fluid from flowing upwardly between the tubing and the rams and to hold the tubing from upward and downward movement, said ram comprising a ram body having a semi-circular cavity for mating with a semi-circular cavity in another ram and encircle the tubing, seals carried by the rams to engage the tubing string and prevent fluid from flowing upwardly past the rams, and slips carried by the ram and positioned in the semi-circular cavity on opposite sides of the seal to hold the tubing from upward and downward movement relative to the ram.

2. A ram for a blowout preventer for coil tubing comprising a ram body having a flat face with a semi-circular cavity therein for engaging the flat face of an oppositely facing ram having a semi-circular cavity in its face, a seal member carried by the ram to engage a section of coil tubing extending vertically between the rams and a seal member carried by the opposite facing ram to prevent the flow of fluid between the rams and the section of coil tubing encircled by the semi-circular cavities in the faces of the rams, a plurality of slip segments mounted on the ram in the semi-circular cavity to engage the tubing and hold the tubing from moving downwardly and a plurality of slips mounted on the ram to hold the tubing from moving upwardly.

3. The rams of claim 1 or 2 further provided with pipe guides for centering the coil tubing in the preventer when the rams move into engagement.

* * * * *